US010662910B2

(12) United States Patent
Cox et al.

(10) Patent No.: US 10,662,910 B2
(45) Date of Patent: May 26, 2020

(54) PARTIAL TRAVEL SOLENOID VALVE ACTUATION ARRANGEMENT

(71) Applicant: Caterpillar Inc., Peoria, IL (US)

(72) Inventors: Glenn B. Cox, Peoria, IL (US); Stephen R. Lewis, Chillicothe, IL (US); Adrienne M. Brasche, Peoria, IL (US); Venkata R. Tatikonda, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 566 days.

(21) Appl. No.: 15/375,551

(22) Filed: Dec. 12, 2016

(65) Prior Publication Data

US 2018/0163677 A1 Jun. 14, 2018

(51) Int. Cl.
*F02M 37/00* (2006.01)

(52) U.S. Cl.
CPC ..... *F02M 37/0023* (2013.01)

(58) Field of Classification Search
CPC ..... F02M 37/0023; F16K 31/06
See application file for complete search history.

(56) References Cited

U.S. PATENT DOCUMENTS 3,450,353 A 6/1969 Eckert
3,830,433 A * 8/1974 Miyake ..... F02M 51/0653 239/533.12
4,568,021 A * 2/1986 Deckard ..... F02M 59/366 239/585.1
5,199,456 A * 4/1993 Love ..... F23N 1/005 137/269
7,083,114 B2 8/2006 Maeurer et al.
7,422,166 B2 9/2008 Hoffmann et al.
8,083,206 B2 12/2011 Manubolu et al.
8,453,951 B2 6/2013 Perry et al.
8,459,577 B2 6/2013 Manubolu et al.
8,899,264 B2 * 12/2014 Young ..... F16K 37/0033 137/554
2015/0059897 A1 * 3/2015 Peterson ..... F16K 11/044 137/625.48
2015/0108246 A1 4/2015 Stucchi et al.
2015/0136099 A1 * 5/2015 Kylstrom ..... F02M 63/0036 123/676

FOREIGN PATENT DOCUMENTS

GB 2152135 A 7/1985

* cited by examiner

*Primary Examiner* — Angelisa L. Hicks
(74) *Attorney, Agent, or Firm* — Miller, Matthias & Hull

(57) ABSTRACT

A valve assembly for a fuel pump is provided. The valve assembly may include an inlet valve limited to a first range of travel extending between a fully closed position and a fully opened position of the inlet valve, a valve pin coupled to the inlet valve, an armature pin selectively engaging the valve pin, and an armature coupled to the armature pin and limited to a second range of travel extending between an engaged position and a disengaged position that is less than the first range of travel.

20 Claims, 4 Drawing Sheets

PARTIAL TRAVEL SOLENOID VALVE ACTUATION ARRANGEMENT

TECHNICAL FIELD

The present disclosure relates generally to fuel delivery systems for internal combustion engines, and more particularly, to valve assemblies and actuation arrangements for engine fuel pumps.

BACKGROUND

Internal combustion engines, such as diesel, gasoline or natural gas engines, may be used to power various different types of machines, such as on-highway trucks or vehicles, off-highway machines, earth-moving equipment, generators, aerospace applications, stationary equipment such as power plants, and the like. In general terms, internal combustion engines are supplied with a mixture of air and fuel, which is ignited at specific timing intervals within a combustion chamber in order to generate mechanical energy, such as reciprocation of a piston within the combustion chamber, and ultimately rotational output torque through a crankshaft capable of driving or operating the associated machine. There are various ongoing efforts to improve the efficiency of the engine and the overall productivity of the associated machine. One possible solution for achieving such improvements lies within the fuel delivery system of the engine.

In general, the fuel delivery system is responsible for taking fuel from a reservoir, and introducing the fuel into the combustion chambers, where the fuel will be mixed with air and ignited. More particularly, the fuel is typically introduced into the combustion chamber through a network of fuel pumps, valves and injectors. For instance, fuel from a fuel tank may be pressurized by a pump chamber, pumped into a common fuel rail through a solenoid valve, and sprayed into a combustion chamber through fuel injectors. Increasing the inlet curtain area of the solenoid valve has been determined to provide higher volumetric efficiency. However, increasing the curtain area may also increase the amount of travel of the solenoid valve, and thus the amount electrical energy needed to actuate the solenoid valve, such as in fuel pumps which electrically actuate the solenoid valve to move between the fully opened and fully closed positions.

Various improvements to solenoid valve assemblies and actuation arrangements are conventionally available. One improvement related to valve assemblies is disclosed in U.S. Pat. No. 7,422,166 ("Hoffman"). Hoffman is aimed at overcoming the adverse effects of valve-bounce in fuel injectors, and discloses a solenoid valve for a fuel injector that is separated into two independent parts, such as an armature and a pintle. In particular, rather than having a single solenoid valve that is actuatable between opened and closed valve positions, Hoffman provides an actuatable armature that is physically separated from the valve or pintle so that any valve bounce does not affect the actual delivery of the fuel. While Hoffman may alleviate some drawbacks associated with valve actuation, Hoffman still relies on its solenoid to move through its full range of motion to actuate the armature. Moreover, Hoffman does not reduce the amount of energy that is used to control the solenoid.

In view of the foregoing disadvantages associated with conventional fuel pumps and associated solenoid valve assemblies, a need exists for a solution which is not only capable of maintaining higher volumetric efficiencies, but also capable of conserving energy while doing so. In particular, there is a need for a valve assembly and an actuation arrangement which maintains large inlet valve curtain areas without requiring additional work by a solenoid to realize the enlarged curtain areas. Furthermore, there is a need for a simplified solution that can be rather easily implemented or retrofitted onto existing fuel pump layouts so as not to require drastic redesigns. The present disclosure is directed at addressing one or more of the deficiencies and disadvantages set forth above. However, it should be appreciated that the solution of any particular problem is not a limitation on the scope of this disclosure or of the attached claims except to the extent expressly noted.

SUMMARY OF THE DISCLOSURE

In one aspect of the present disclosure, a valve assembly for a fuel pump is provided. The valve assembly may include an inlet valve limited to a first range of travel extending between a fully closed position and a fully opened position of the inlet valve, a valve pin coupled to the inlet valve, an armature pin selectively engaging the valve pin, and an armature coupled to the armature pin and limited to a second range of travel extending between an engaged position and a disengaged position that is less than the first range of travel.

In another aspect of the present disclosure, an actuation arrangement for a fuel pump having a pump housing, a passageway and a pump chamber is provided. The actuation arrangement may include an inlet valve disposed in communication between the passageway and the pump chamber and limited to a first range of travel extending between a fully closed position and a fully opened position of the inlet valve, a valve pin disposed within the passageway and coupled to the inlet valve, an armature pin selectively engaging the valve pin, an armature coupled to the armature pin and limited to a second range of travel extending between an engaged position and a disengaged position that is less than the first range of travel, and a solenoid operatively coupled to the armature and configured to selectively adjust the armature between the engaged position and the disengaged position.

In yet another aspect of the present disclosure, a fuel pump is provided. The fuel pump may include a pump housing, a pump chamber disposed within the pump housing and in communication with the fuel pump, a passageway disposed within the pump housing and in communication with the pump chamber, an inlet valve disposed in communication between the pump chamber and the passageway and limited to a first range of travel, a valve pin disposed within the passageway and coupled to the inlet valve, an armature pin selectively engaging the valve pin, an armature coupled to the armature pin and limited to a second range of travel that is less than the first range of travel and extends between an engaged position and a disengaged position, and a solenoid operatively coupled to the armature and configured to selectively adjust the armature between the engaged position and the disengaged position.

These and other aspects and features will be more readily understood when reading the following detailed description in conjunction with the accompanying drawings.

While the following detailed description is given with respect to certain illustrative embodiments, it is to be understood that such embodiments are not to be construed as limiting, but rather the present disclosure is entitled to a scope of protection consistent with all embodiments, modifications, alternative constructions, and equivalents thereto.

DETAILED DESCRIPTION

Figure 1:
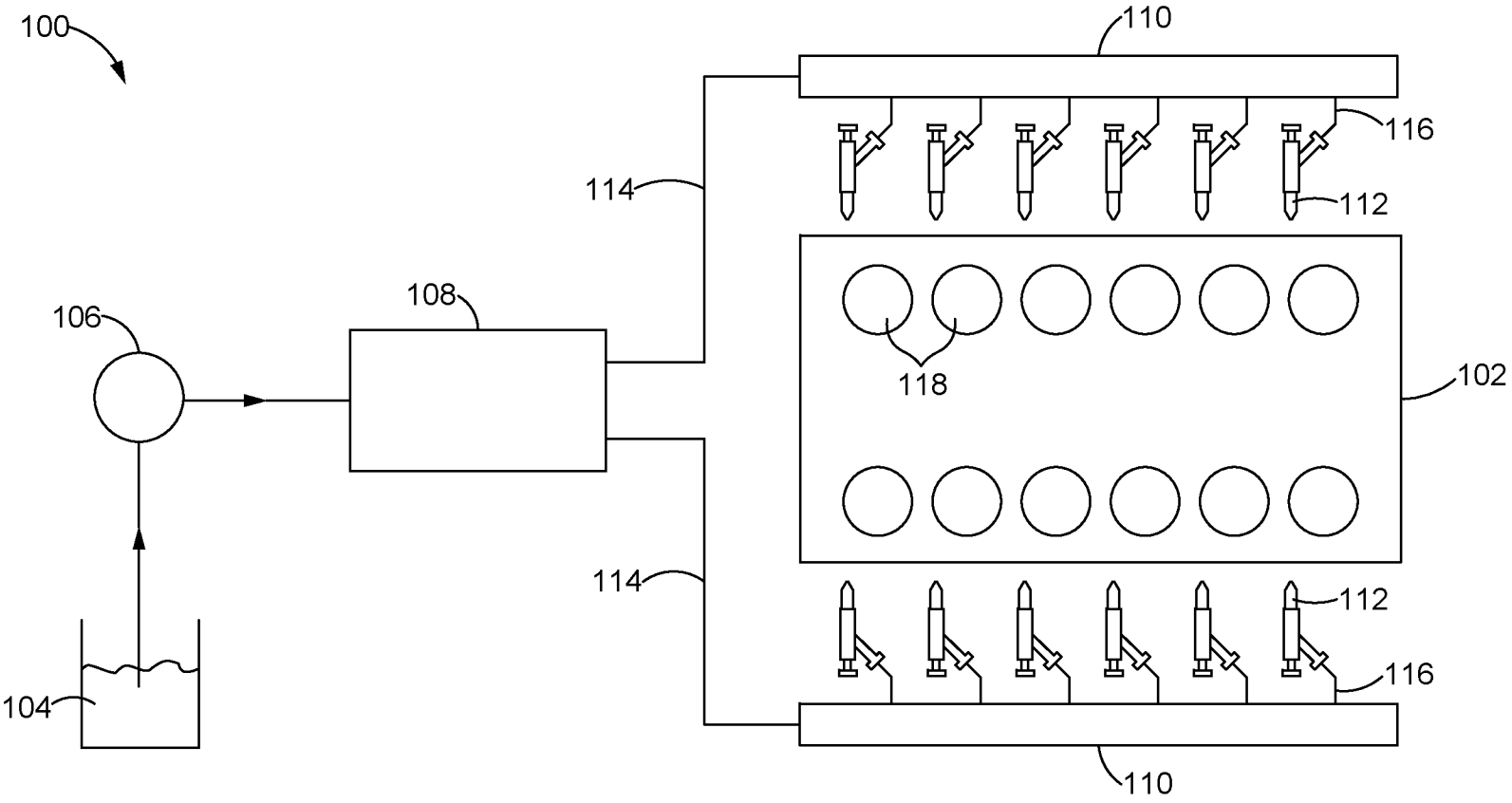
FIG. 1 is a schematic view of one exemplary embodiment of a fuel delivery system of the present disclosure.

Referring to FIG. 1, one exemplary embodiment of a fuel delivery system 100 for an internal combustion engine 102 is schematically provided. As shown, the fuel delivery system 100 may generally include a fuel tank 104, a transfer pump 106, a fuel pump 108, one or more common fuel rails 110, and one or more fuel injectors 112. In particular, fuel from the fuel tank 104 may be transferred by the low pressure transfer pump 106 to the high pressure fuel pump 108. Once pressurized, fuel from the fuel pump 108 may be supplied through fuel lines 114 to the fuel rails 110. In turn, each fuel rail 110 may supply the pressurized fuel to each of the fuel injectors 112 through injection lines 116. Upon actuation, each of the fuel injectors 112 may spray the pressurized fuel into the corresponding combustion chamber 118 of the engine 102. The engine 102 shown in FIG. 1 may be a diesel engine, a gasoline engine, a natural gas engine, or the like. Furthermore, while the fuel delivery system 100 is shown in one possible arrangement, other arrangements are possible and will be apparent to those of ordinary skill in the art.

Figure 2:
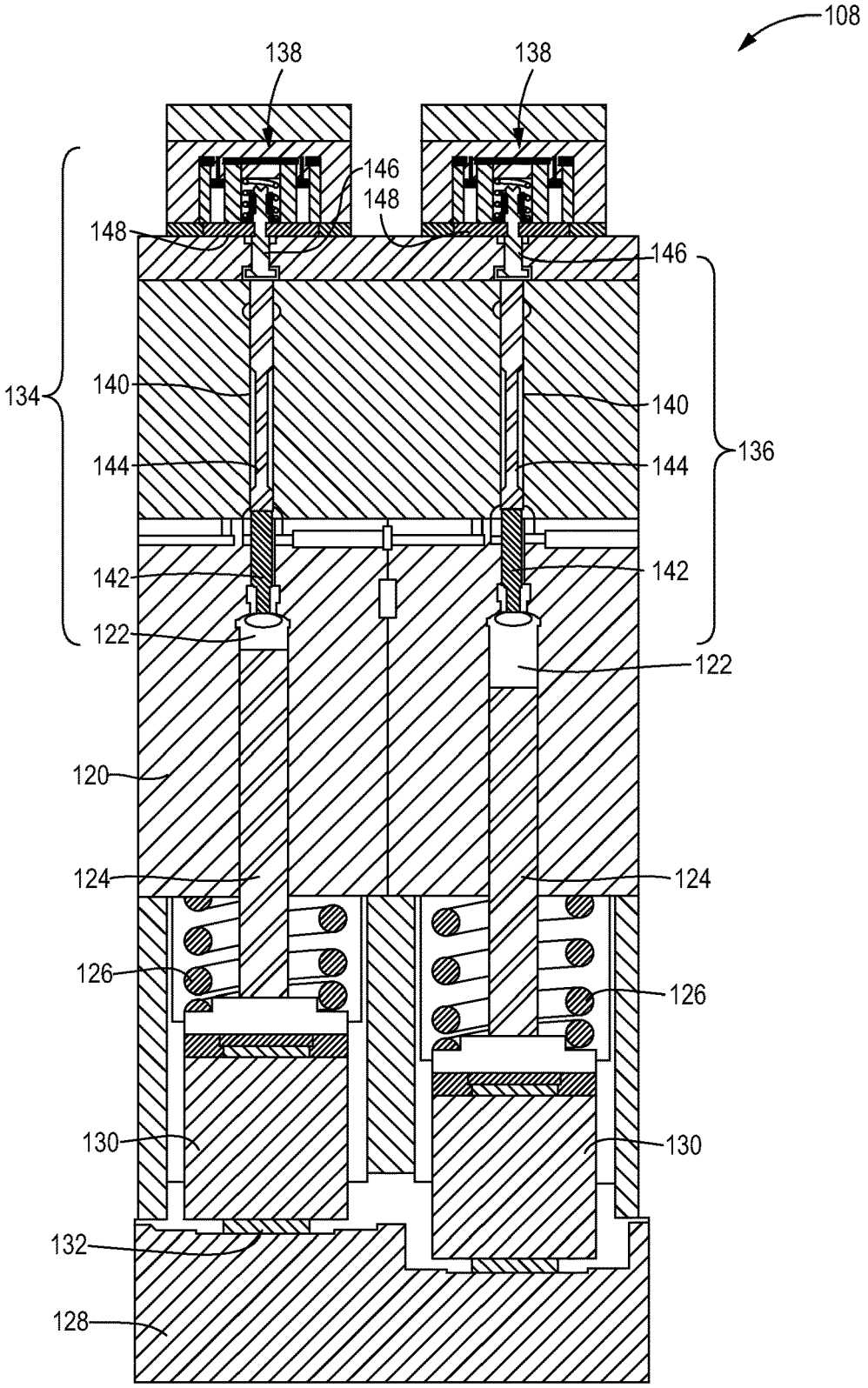
FIG. 2 is a partial, cross-sectional view of one exemplary embodiment of fuel pump of the present disclosure.

Turning to FIG. 2, one exemplary embodiment of a fuel pump 108 that may be used in conjunction with the fuel delivery system 100 and engine 102 of FIG. 1 is shown in more detail. As shown, the fuel pump 108 is enclosed within a pump housing 120 that is coupled to or at least partially integrated into the engine 102 or a housing thereof. The pump housing 120 further defines one or more pump chambers 122, each of which may slidably receive a reciprocating plunger 124. More specifically, each plunger 124 may be biased into the uncompressed position by a cam spring 126, but forced to compress via a mechanical interface formed with the engine camshaft 128. For example, the plungers 124 are provided with cam followers 130 which press against the lobes 132 of the camshaft 128 and convert the rotary motion of the camshaft 128 into the reciprocal motion of the plungers 124. Furthermore, the reciprocating motion of the plungers 124 may serve to pressurize the low pressure fuel supplied by the transfer pump 106 of FIG. 1.

Still referring to FIG. 2, the fuel pump 108 may further include one or more actuation arrangements 134 coupled thereto, for example one actuation arrangement 134 for each available pump chamber 122 of the fuel pump 108. Specifically, each actuation arrangement 134 includes a valve assembly 136 and a solenoid 138 for actuating the valve assembly 136. In particular, the valve assembly 136 may be disposed within a passageway 140 that is in fluid communication with the corresponding pump chamber 122 and at least partially defined within the pump housing 120, while the solenoid 138 may be disposed on the pump housing 120. The valve assembly 136 is arranged to selectively introduce pressurized fuel from the pump chamber 122 through the fuel lines 114 and into the fuel rails 110, in response to actuation by the solenoid 138. Correspondingly, the solenoid 138 may be actuated, or electrically toggled between energized and de-energized states, according to predetermined frequencies derived based on the pressure within the associated pump chamber 122 and/or the rotational speed of the camshaft 128.

Figure 4:
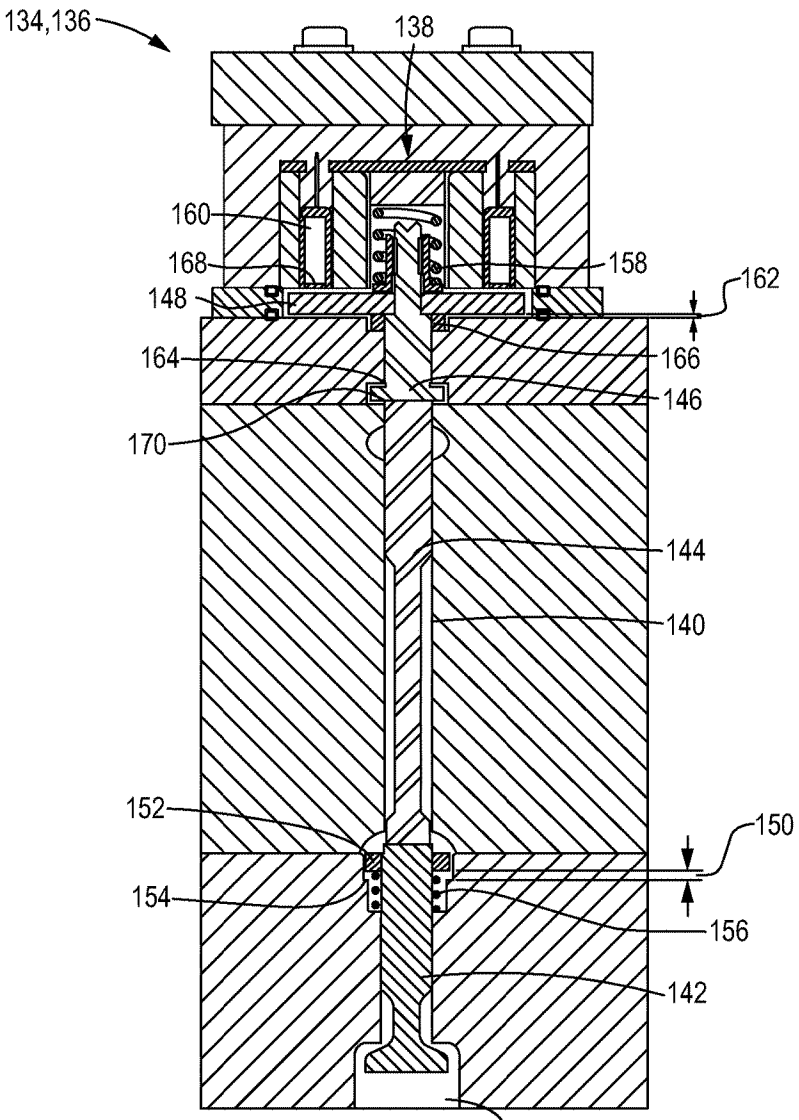
FIG. 4 is a cross-sectional view of one exemplary valve assembly and actuation arrangement of the present disclosure in an energized state and a partially open position.
Figure 3:
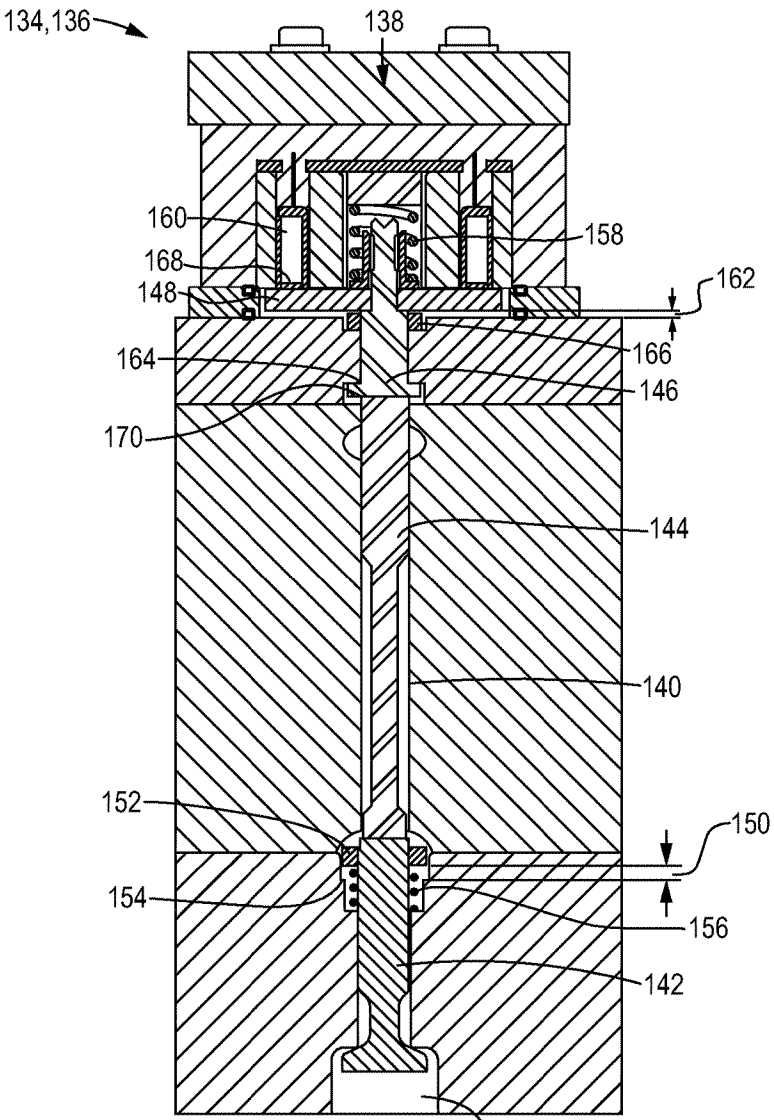
FIG. 3 is a cross-sectional view of one exemplary valve assembly and actuation arrangement of the present disclosure in a de-energized state and a closed position.

Turning now to FIGS. 3 and 4, exemplary embodiments of an actuation arrangement 134 and an associated valve assembly 136 are provided. As shown, the valve assembly 136 includes an inlet valve 142, a valve pin 144 coupled to the inlet valve 142, an armature pin 146 selectively engaging the valve pin 144, and an armature 148 coupled to the armature pin 146. The inlet valve 142 is disposed in communication between the pump chamber 122 and the passageway 140, and allowed to move at least between a closed position as shown in FIG. 3 and a partially opened position as shown in FIG. 4. When closed, the inlet valve 142 may substantially seal the pump chamber 122 from the passageway 140. When opened, the inlet valve 142 may allow fluid to communicate between the pump chamber 122 and the passageway 140. The inlet valve 142 is also limited to a first range of travel 150, extending between a fully closed position and a fully opened position. The first range of travel 150 may be defined by an arrangement of valve retainers 152 and one or more valve stops 154 defined within the passageway 140. A return spring 156 may also be positioned between inlet valve 142 and the passageway 140 to bias the inlet valve 142 in the fully closed position.

More specifically, the valve retainers 152 of FIGS. 3 and 4 may be rigidly coupled to an outer surface of the inlet valve 142 so as to reciprocate with the inlet valve 142. The valve retainers 152 can take the form of rings or tabs that are fitted or threaded onto the outer surface of the inlet valve 142 so as to extend radially outward therefrom. Furthermore, the valve retainers 152 may be sized to be small enough to allow the inlet valve 142 to reciprocate within the passageway 140, but large enough to come into contact with the valve stops 154, and thereby stopped from further travelling toward the pump chamber 122. The valve stops 154 may be defined by grooves or recesses formed within the passageway 140, and sized to make physical contact with the valve retainers 152 and prevent the inlet valve 142 from further opening once in a fully opened position. The return spring 156 may be provided around the inlet valve 142, and positioned in between the valve retainers 152 and the passageway 140 in a manner which presses against the valve retainers 152 and biases the inlet valve 142 closed. In addition, the return spring 156 may be sized to be large enough to fit around the outer surface of the inlet valve 142 and make contact with the valve retainers 152, but small enough to clear and avoid contact with the valve stops 154.

As shown in FIGS. 3 and 4, the valve pin 144 is longitudinally positioned within the passageway 140 and configured to mechanically interact between the inlet valve 142 and the armature pin 146. For example, the valve pin 144 may be rigidly coupled to the inlet valve 142, but separable from the armature pin 146 so as to come into contact with the armature pin 146 only during certain stages of operation. Specifically, the solenoid 138 may cause the armature 148 and the armature pin 146 to move between an engaged position, which pushes the armature pin 146 against the valve pin 144, and a disengaged position, which pulls the armature pin 146 away from the valve pin 144 and relieves pressure from the valve pin 144. The solenoid 138 may include a solenoid spring 158 which biases the armature pin 146 into the engaged position, and a solenoid coil 160 which selectively overcomes the biasing force of the solenoid spring 158 to pull the armature pin 146 into the disengaged position. As is understood in the art, the solenoid coil 160 may selectively receive an electrical current therethrough to induce an electromagnetic force that moves the armature pin 146 in a desired direction, such as toward the solenoid coil 160 and away from the valve pin 144.

Correspondingly, when the solenoid 138 is in an energized state, the armature pin 146 may be moved into the disengaged position shown in FIG. 3, and when the solenoid 138 is in a de-energized state, the armature pin 146 may be moved into the engaged position shown in FIG. 4. More specifically, in the disengaged position of FIG. 3, the solenoid 138 overcomes the force applied by the solenoid spring 158, pulls the armature pin 146 away from the valve pin 144, and allows the inlet valve 142 to travel between fully opened and fully closed positions as determined by, for instance, pressure differentials across the inlet valve 142. In the engaged position of FIG. 4, the solenoid 138 restores control to the solenoid spring 158 to push the armature pin 146 against the valve pin 144, force the inlet valve 142 into the partially opened position shown, and prevent the inlet valve 142 from fully closing. Although the armature pin 146 may be limited from further engaging and extending the inlet valve 142 beyond the partially opened position, as will be discussed more specifically below, the inlet valve 142 is still allowed to open further, such as due to pressure differentials across the inlet valve 142.

Based on the embodiments shown in FIGS. 3 and 4, the return spring 156 may be configured with a spring force sized to be overcome by forces associated with the solenoid spring 158 and/or any pressure differentials across the inlet valve 142, while the solenoid spring 158 may be configured with a spring force sized to withstand forces associated with the return spring 156 and pressure differentials across the inlet valve 142. Furthermore, the valve assembly 136 may also be arranged to limit the armature pin 146 and the armature 148 to a second range of travel 162, such as between the engaged position and the disengaged position, which is less than the first range of travel 150 of the inlet valve 142. For example, the armature pin 146 may be prevented from travelling beyond the disengaged position of FIG. 3 by one or more armature pin stops 164 disposed within the passageway 140, while the armature 148 may be prevented from travelling beyond the engaged position of FIG. 4 by one or more armature shims 166 installed on the pump housing 120. Still further, the valve assembly 136 may also provide one or more shims 168 disposed between the armature 148 and the solenoid 138 arranged to maintain a predefined minimum air gap therebetween.

More particularly, as shown in FIGS. 3 and 4, the armature pin 146 may be provided with an enlarged diameter portion 170 sized to mate with the armature pin stops 164, which may be defined by grooves or recessed formed within the passageway 140 or pump housing 120. Moreover, the armature pin stops 164 are sized to make physical contact with the enlarged diameter portion 170 and prevent the armature pin 146 from travelling further toward the solenoid 138 when in the energized state as shown in FIG. 3. The armature shims 166 may be rigidly coupled to or formed within the passageway 140, or alternatively, rigidly coupled to or radially formed on an outer surface of the armature pin 146 so as to reciprocate with the armature pin 146. In particular, the armature shims 166 are sized to make contact with and prevent the armature 148 from travelling further away from the solenoid 138 when in the de-energized state as shown in FIG. 4. The armature shims 166 can take the form of a ring that is fitted around the outer surface of the armature pin 146, or as one or more tabs that extend radially outward therefrom. Furthermore, the shims 168 may be rigidly installed onto either the solenoid 138 or the armature 148, and arranged to prevent the armature 148 from making direct contact with the solenoid 138 or the solenoid coil 160.

INDUSTRIAL APPLICABILITY

In general, the present disclosure finds utility in various applications including motorized transport platforms, such as automobiles, buses, trucks, tractors, and most off-road machines employed in agriculture, mining, and construction. Utility may also extend to earth-moving equipment, industrial work machines, generators, aerospace applications, stationary equipment such as power plants, and the like. Specifically, the disclosed valve assemblies, actuation arrangements, fuel pumps and fuel delivery systems may find potential utility for use with internal combustion engines, such as diesel engines, gasoline engines, natural gas engines, or any other such compression-ignition engines employing high-pressure fuel systems. The present disclosure may find specific utility with electrically actuated solenoid valves used to operate fuel pumps with increased inlet curtain areas and increased inlet valve travel. In particular, by limiting the range of travel of the armature, the present disclosure is able to reduce the amount of electrical energy that is consumed by the solenoid. Also, by allowing the valve pin to selectively separate from the armature, the present disclosure is able to maintain increased valve travel despite the reduction in armature travel.

Figure 5:
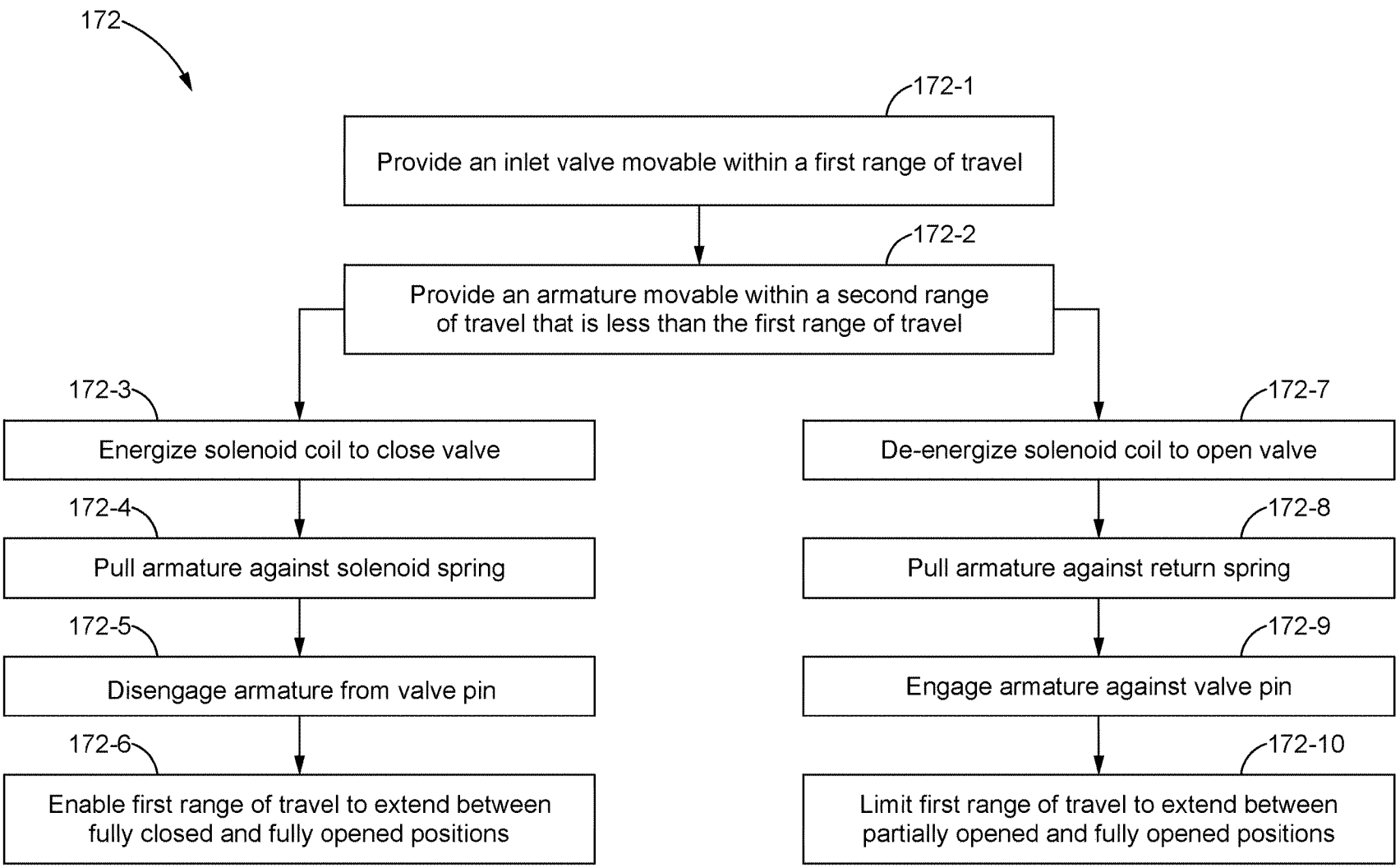
FIG. 5 is a flow diagram of one exemplary method of using the actuation arrangement of the present disclosure.

Turning now to FIG. 5, one exemplary method 172 of using the actuation arrangement 134 is provided. As shown, the method 172 in block 172-1 initially provides an inlet valve 142 that is movable within a first range of travel 150, while the method 172 in block 172-2 provides an armature 148 that is movable within a second range of travel 162 that is less than the first range of travel 150. For example, the inlet valve 142 may be limited to the first range of travel 150 using the arrangement of the valve retainers 152 and valve stops 154 shown in FIGS. 3 and 4, and the armature 148 may be limited to the second range of travel 162 using the arrangement of pin stops 164, armature shims 166 and shims 168 also shown in FIGS. 3 and 4. Furthermore, the inlet valve 142 can be allowed to open or close via control of an associated solenoid 138. In the embodiments shown in FIGS. 3-5, for example, the solenoid 138 allows the inlet valve 142 to fully close when the solenoid coil 160 is electrically energized, and at least partially opened when the solenoid coil 160 is electrically de-energized. However, alternative arrangements for actuating the solenoid 138 and/or the valve assembly 136 will be apparent to those skilled in the art.

Still referring to FIG. 5, to close the inlet valve 142, the method 172 in block 172-3 energizes the solenoid coil 160, or allows electrical current to pass through the solenoid coil 160, to induce an electromagnetic field near the armature 148 or around the armature pin 146. For instance, the armature pin 146 may be formed of a metallic or other conductive material that is capable of interacting with the electromagnetic field. The resulting electromagnetic force may pull or retract the armature 148 against the force of the associated solenoid spring 158 and toward the solenoid coil 160 in block 172-4. As the armature pin 146 is pulled toward the solenoid coil 160, the armature 148 is physically disengaged from the valve pin 144 in block 172-5. Moreover, disengaging the armature 148 from the valve pin 144 allows the inlet valve 142 to reciprocate within a first range of travel 150 extending between a fully closed position and a fully opened position in block 172-6. Furthermore, the range of travel 162 of the armature 148 may be maintained to be less than the range of travel 150 of the inlet valve 142.

Alternately, to open the inlet valve 142, the method 172 in block 172-7 of FIG. 5 de-energizes the solenoid coil 160, or electrically discharges the solenoid coil 160, to restore control of the armature 148 to the solenoid spring 158. For example, the spring force of the solenoid spring 158 may be sufficiently sized to overpower that of the return spring, but sufficiently limited to be overpowered by the electromagnetic force induced by the solenoid coil 160. More specifically, de-energizing the solenoid coil 160 enables the solenoid spring 158 to push the armature 148 against the opposing return spring 156 coupled to the inlet valve 142 in block 172-8. The armature 148 is allowed to further engage or push against the valve pin 144 and the inlet valve 142 in block 172-9. Furthermore, the inlet valve 142 is forced into a partially opened position, prevented from fully closing, and thereby limited to reciprocation between the partially opened position and the fully opened position in block 172-10. The range of travel 162 of the armature 148 is maintained to be less than the range of travel 150 of the inlet valve 142 under either energized or de-energized state. Moreover, although the armature shims 166 may limit the armature 148 and armature pin 146 from engaging the inlet valve 142 further beyond the partially opened position, the inlet valve 142 is still allowed to open further, such as due to pressure differentials across the inlet valve 142.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A valve assembly for a fuel pump, the valve assembly comprising:

an inlet valve limited to a first range of travel extending between a fully closed position and a fully opened position of the inlet valve, the inlet valve including one or more valve retainers rigidly coupled to an outer surface of the inlet valve arranged to interface with one or more valve stops disposed within a passageway;

a valve pin coupled to the inlet valve;

an armature pin selectively engaging the valve pin; and an armature coupled to the armature pin and limited to a second range of travel extending between an engaged position and a disengaged position that is less than the first range of travel.

2. The valve assembly of claim 1, wherein the inlet valve is limited to the first range of travel by the one or more valve retainers and the one or more valve stops, and the armature is limited to the second range of travel by one or more armature shims and one or more armature pin stops.

3. The valve assembly of claim 2, wherein the one or more valve retainers are arranged to interface with the one or more valve stops to prevent the inlet valve from travelling beyond the fully opened position.

4. The valve assembly of claim 2, wherein the one or more armature shims are arranged to interface with the armature to prevent the armature from travelling beyond the engaged position, and the one or more armature pin stops are arranged to interface with the armature pin to prevent the armature pin from travelling beyond the disengaged position.

5. The valve assembly of claim 1, wherein the armature pin in the engaged position is arranged to at least partially open the inlet valve and prevent the inlet valve from fully closing.

6. The valve assembly of claim 1, wherein the inlet valve is biased in the fully closed position by a return spring, and the armature is biased in the engaged position by a solenoid spring.

7. An actuation arrangement for a fuel pump having a pump housing, a passageway and a pump chamber, the actuation arrangement comprising:

an inlet valve disposed in communication between the passageway and the pump chamber and limited to a first range of travel extending between a fully closed position and a fully opened position, a portion of the inlet valve being disposed in the pump chamber, the inlet valve including one or more valve retainers rigidly coupled to an outer surface of the inlet valve arranged to interface with one or more valve stops disposed within the passageway;

a valve pin disposed within the passageway and coupled to the inlet valve;

an armature pin selectively engaging the valve pin;

an armature coupled to the armature pin and limited to a second range of travel extending between an engaged position and a disengaged position that is less than the first range of travel; and a solenoid operatively coupled to the armature and configured to selectively adjust the armature between the engaged position and the disengaged position.

8. The actuation arrangement of claim 7, wherein the inlet valve is limited to the first range of travel by the one or more valve retainers and the one or more valve stops, and the armature is limited to the second range of travel by one or more armature shims and one or more armature pin stops.

9. The actuation arrangement of claim 7, wherein the solenoid includes a solenoid spring and a solenoid coil, the solenoid spring being configured to maintain the armature in the engaged position when the solenoid coil is not energized, and the solenoid coil being configured to electromagnetically actuate the armature into the disengaged position when energized.

10. The actuation arrangement of claim 9, wherein the armature pin is arranged to abut the valve pin to at least partially open the inlet valve and prevent the inlet valve from fully closing when the solenoid is not energized, and release the valve pin to enable the inlet valve to fully close when the solenoid is energized.

11. The actuation arrangement of claim 7, wherein the inlet valve is biased in the fully closed position by a return spring, and the armature is biased in the engaged position by a solenoid spring.

12. The actuation arrangement of claim 11, wherein the return spring is provided with a spring force sized to be overcome by forces associated with one or more of the solenoid spring and pressure differentials across the inlet valve, and the solenoid spring is provided with a spring force sized to withstand forces associated with one or more of the return spring and pressure differentials across the inlet valve.

13. A fuel pump, comprising:

a pump housing;

a pump chamber disposed within the pump housing and in communication with the fuel pump;

a passageway disposed within the pump housing and in communication with the pump chamber;

an inlet valve disposed in communication between the pump chamber and the passageway and limited to a first range of travel, a portion of the inlet valve being disposed in the pump chamber, the inlet valve including one or more valve retainers rigidly coupled to an outer surface of the inlet valve arranged to interface with one or more valve stops disposed within the passageway;

a valve pin disposed within the passageway and coupled to the inlet valve;

an armature pin selectively engaging the valve pin;

an armature coupled to the armature pin and limited to a second range of travel that is less than the first range of travel and extends between an engaged position and a disengaged position; and a solenoid operatively coupled to the armature and configured to selectively adjust the armature between the engaged position and the disengaged position.

14. The fuel pump of claim 13, wherein the one or more valve retainers are arranged to interface with the one or more valve stops disposed within the passageway to prevent the inlet valve from travelling beyond a fully opened position.

15. The fuel pump of claim 13, further comprising one or more armature shims and one or more armature pin stops, the one or more armature shims being disposed on the pump housing and configured to interface with the armature to prevent the armature from travelling beyond the engaged position, and the one or more armature pin stops being disposed within the passageway and configured to interface with the armature pin to prevent the armature pin from travelling beyond the disengaged position.

16. The fuel pump of claim 13, further comprising one or more shims disposed between the armature and the solenoid and arranged to maintain a predefined minimum air gap therebetween.

17. The fuel pump of claim 13, wherein the solenoid is configured to maintain the armature in the engaged position when the solenoid is not energized, and electromagnetically actuate the armature into the disengaged position when the solenoid is energized.

18. The fuel pump of claim 17, wherein the armature pin is arranged to abut the valve pin to at least partially open the inlet valve and prevent the inlet valve from fully closing when the solenoid is not energized, and release the valve pin to enable the inlet valve to fully close when the solenoid is energized.

19. The fuel pump of claim 13, wherein the inlet valve is biased in a fully closed position by a return spring, and the armature is biased in the engaged position by a solenoid spring.

20. The fuel pump of claim 19, wherein the return spring is provided with a spring force sized to be overcome by forces associated with one or more of the solenoid spring and pressure differentials across the inlet valve, and the solenoid spring is provided with a spring force sized to withstand forces associated with one or more of the return spring and pressure differentials across the inlet valve.

* * * * *